United States Patent [19]

Lambert

[11] Patent Number: 4,714,077

[45] Date of Patent: Dec. 22, 1987

[54] REPLENISHABLE SELF CONTAINED BREATHING APPARATUS

[75] Inventor: William M. Lambert, Pittsburgh, Pa.

[73] Assignee: Mine Safety Appliances Company, Pittsburgh, Pa.

[21] Appl. No.: 832,371

[22] Filed: Feb. 24, 1986

[51] Int. Cl.[4] ..... A62B 9/04; A62B 7/00

[52] U.S. Cl. ..... 128/202.27; 128/204.18; 128/205.24

[58] Field of Search ..... 128/202.27, 205.24, 128/205.28, 202.22, 204.28, 204.18, 202.14, 912, 204.26

[56] References Cited

U.S. PATENT DOCUMENTS

| | | | |
|---|---|---|---|
| 2,406,888 | 9/1946 | Meidenbauer | 128/205.24 |
| 2,453,475 | 11/1948 | Tobias | 128/202.27 |
| 2,764,151 | 9/1956 | Cupp | 128/202.22 |
| 2,854,001 | 9/1958 | Humblet | 128/202.22 |
| 3,208,449 | 9/1965 | Bartlett, Jr. | 128/204.28 |
| 3,238,943 | 3/1966 | Holley | 128/202.27 |
| 3,433,222 | 3/1969 | Pinto | 128/202.27 |
| 3,521,627 | 7/1970 | Murray | 128/202.27 |
| 3,575,167 | 4/1971 | Michielsen | 128/205.28 |
| 3,995,626 | 12/1976 | Pearce, Jr. | 128/202.27 |
| 4,111,342 | 9/1978 | Kirby | 128/202.27 |
| 4,328,798 | 5/1982 | Issacson | 128/202.27 |
| 4,449,524 | 5/1984 | Gray | 128/205.24 |
| 4,522,639 | 6/1985 | Ansite et al. | 128/205.24 |

FOREIGN PATENT DOCUMENTS

| | | | |
|---|---|---|---|
| 216459 | 5/1924 | United Kingdom | 128/202.22 |

*Primary Examiner*—Edward M. Coven
*Assistant Examiner*—K. M. Reichle
*Attorney, Agent, or Firm*—Reed Smith Shaw & McClay

[57] ABSTRACT

A high pressure breathing gas transfer system is provided where high pressure air from a tank of one SCBA, or a central storage supply, can be quickly transferred directly into the high pressure air tank of a second SCBA. The transfer process, between two SCBA's, is accomplished by attaching a high pressure conduit line between two quick connect check valves situated on the high pressure sides of the SCBA's. The high pressure transfer line has a quick connect coupling attached to each end to enable connection to the check valves. After the line is attached, a lever is depressed on donor couplings to open the donor check valve. High pressure air then flows out of the donor tank and forces the check valve open on the donee tank. The air transfer continues until the internal pressure of the two tanks is equalized and the donee tank has received half of the air that was initially inside the donor tank. Because the air is transferred on the high pressure side of the regulator, the system may be used to accomplish buddy-breathing between two SCBA users in emergency situations, without interfering with the normal breathing operation of the SCBA's.

9 Claims, 5 Drawing Figures

REPLENISHABLE SELF CONTAINED BREATHING APPARATUS

FIELD OF THE INVENTION

The invention relates to self contained breathing apparatuses (SCBA), and more particularly to a system whereby the air supply of one SCBA can be replenished by rapidly transferring high pressure air directly from the air supply of a second SCBA, or other air supply, without interfering with the normal breathing of the SCBA users.

BACKGROUND OF THE INVENTION

Emergency personnel, such as firemen, are often required to use SCBA's when working around a toxic atmosphere. Whenever emergency workers must use SCBA's, their effectiveness is curtailed because of the limited supply of air that is provided in a SCBA. When a worker's air supply becomes depleted, he must leave the scene of the emergency to replace the empty tank. Given this limitation, workers waste valuable time leaving the scene to refill their air tanks.

Similarly any time that a worker uses an SCBA, he becomes dependent on his air supply. If the worker becomes trapped or injured and can not leave the scene on his own, he will suffocate when his air supply is exhausted. To save the trapped worker's life, the worker can share the air supply of another worker using an SCBA. The sharing of air supplies is called "buddy breathing".

The concept of buddy breathing is a relatively old idea in which two persons using SCBA's share a single SCBA's air supply to provide mutual safety, when one user faces air depletion during a hazardous situation. The air is normally shared by taking low pressure air directly from the mask or regulator of the donor SCBA. The concept of sharing an air supply by taking low pressure air directly from the regulator has been disclosed in numerous U.S. patents including: Kirby, U.S. Pat. No. 4,111,342; Mattingly, U.S. Pat. No. 4,392,490; and Gray, U.S. Pat. No. 4,449,524.

There are problems inherent in such methods of sharing air. One problem is that both men are joined together throughout the procedure. When the men are attached together, it is often impossible to exit a building through small escape paths such as windows or doors. It is also possible that a connecting air tube can become damaged or entangled. Further, this arrangement necessitates that both men leave the emergency scene at the same time so that the man with the exhausted air supply can reach a safe atmosphere. This means that an additional worker is temporarily deterred from fighting the emergency.

Another situation in which this arrangement presents a problem is when one worker becomes trapped. In order for another man to share his air supply, he must remain with the trapped worker until help arrives, thereby endangering his own life as well.

SUMMARY OF THE INVENTION

An object of this invention is to provide a means to replenish the air supply of an SCBA while the SCBA is in use. A further object is to replenish the air supply from a second SCBA while it too is in use. A further object is to provide such replenishment by rapidly refilling the depleted SCBA air tank with high pressure air taken directly from the donor tank of a second SCBA.

This arrangement allows the man in need of air to continue to breath directly from the air mask of his own SCBA since the air tank itself is partially refilled.

In accordance with this invention, the high pressure air transfer system comprises at least one SCBA that is low on breathing air to act as a donee SCBA. The donee SCBA is comprised of: a high pressure breathing gas source, suitably an air tank including associated high-pressure fittings, having an outlet; a valve means for closing the outlet, a pressure reducing means fluidly connected to said high pressure source; a breathing hose fluidly connected to said pressure reducing means; a breathing means, preferably an air mask, fluidly connected to said breathing hose; and, a high pressure conduit detachably connecting said valve means. The system further requires a donor air source such as another SCBA air tank or central storage supply of compressed high pressure air.

The present invention provides a system whereby the donee tank can be immediately filled with high pressure air, either from the tank of a donor SCBA or from a central air supply, by temporarily connecting an air transfer line, preferably with quick connect fittings, between two high pressure valved outlets. The valves incorporated into each SCBA or the central storage supply are preferably check valves that normally close the outlet. The transfer between a donee SCBA and donor SCBA occurs since the internal pressure of the donor tank is higher than the internal pressure of the donee tank. When the two are connected by a common line, there is a transfer of air from the higher pressure donor tank into the lower pressure donee tank as the internal pressure in the newly formed system is equalized.

The transfer line is then disconnected by pulling the quick connect fittings from the outlets. Either man can now exit the scene individually to obtain a new air supply or remain at the scene to continue responding to the emergency. The invention also makes it possible for workers to remain at the scene almost indefinitely, as one person can bring in new air to all of the workers at the scene.

It is a feature of this invention that the air transfer is done entirely on the high pressure side of the regulator without interfering with the normal operation of the low pressure side of the regulator to provide breathing air.

DESCRIPTION OF THE PREFERRED EMBODIMENT

Figure 1:
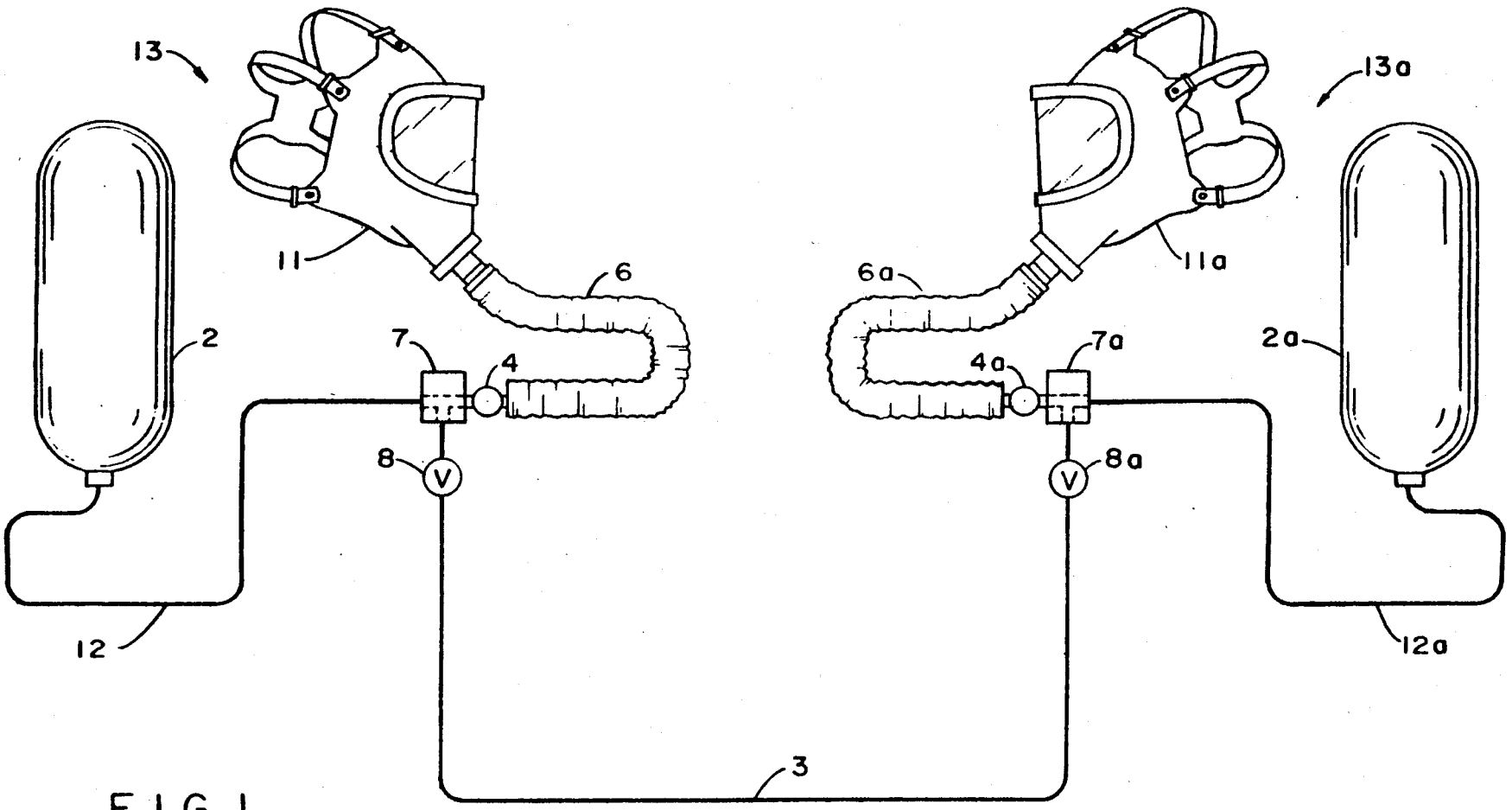
FIG. 1 is a schematic view of a high pressure gas transfer system.

With reference to FIG. 1, the transfer system comprises two SCBA's 13 and 13*a*, with high pressure air tanks 2 and 2*a*. The tank opens (conventionally through a tank valve, not shown) through conduit 12(12*a*) to a T-coupling 7 (7*a*). One outlet of T-coupling 7 (7*a*) is closed by valve 8 (8*a*) and a pressure reducing means, such as a demand or pressure-demand regulator 4 (4*a*) is connected to the other coupling outlet. For the purposes of this application, the entire portion of the SCBA at high (tank) pressure, the tank 2 (2*a*), line 12 (12*a*), and coupling 7 (7*a*), is considered as the air source. When high pressure air is available to regulator 4 (4*a*), it reduces the pressure to provide low pressure breathing air through air hose 6 (6*a*) to mask 11 (11*a*) or other breathing piece.

When the user of apparatus 13*a* begins to run out of air, high pressure air can be transferred directly and rapidly from the air tank 2 of apparatus 13 into the depleted tank 2*a* of apparatus 13*a*. The transfer is accomplished by connecting conduit 3 to valves 8 and 8*a*, and opening the valves, providing a fluid connection between the two apparatuses. Air rapidly flows from tank 2 to tank 2*a* until the pressure equalizes, providing breathing air to apparatus 13*a*. Valves 8 and 8*a* are closed, conduit 3 is disconnected, and each user has an independent supply of air.

Alternatively, the user can replenish his air supply, without changing tanks, from a separate supply tank having an outlet adapted to be connected to conduit 3. For example, fire trucks can be equipped with such supply tanks, obviating the present practice of carrying replacement tanks to fire scenes.

Valve 8, 8*a* is preferably a check valve that normally closes flow out from coupling 7. Means are provided, preferably as a part of the means connecting conduit 3 with valve 8 (8*a*), to open the check valve on the donor apparatus.

Figure 2:
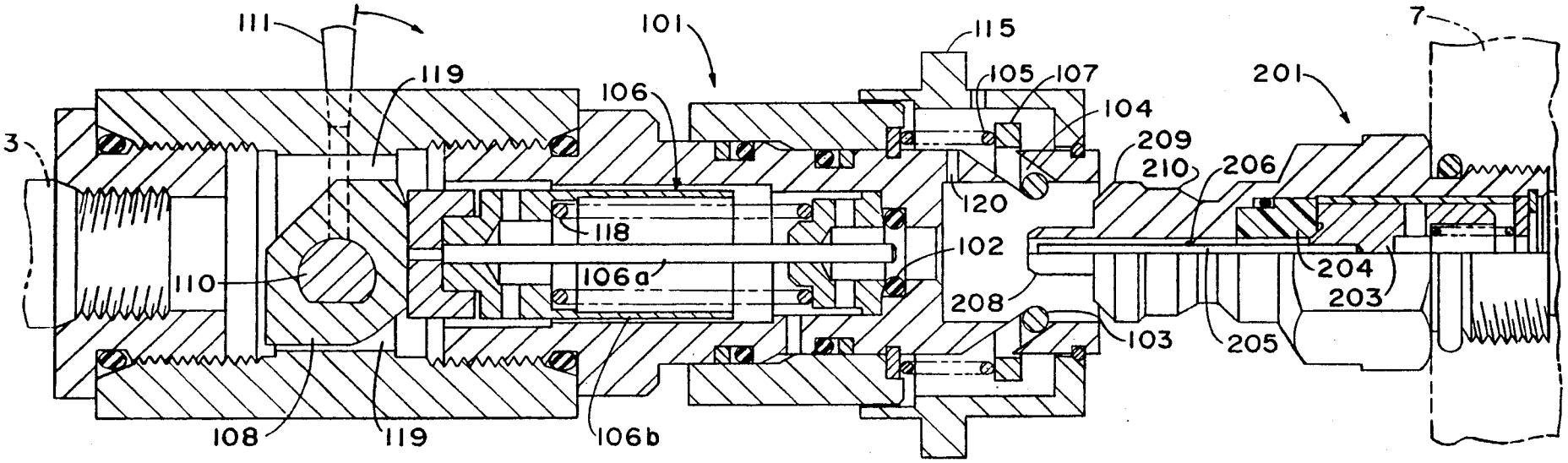
FIG. 2 is a cross sectional view of an embodiment of a quick connect check valve and socket assembly suitable for use in the system of FIG. 1 in a fully disconnected position.
Figure 3:
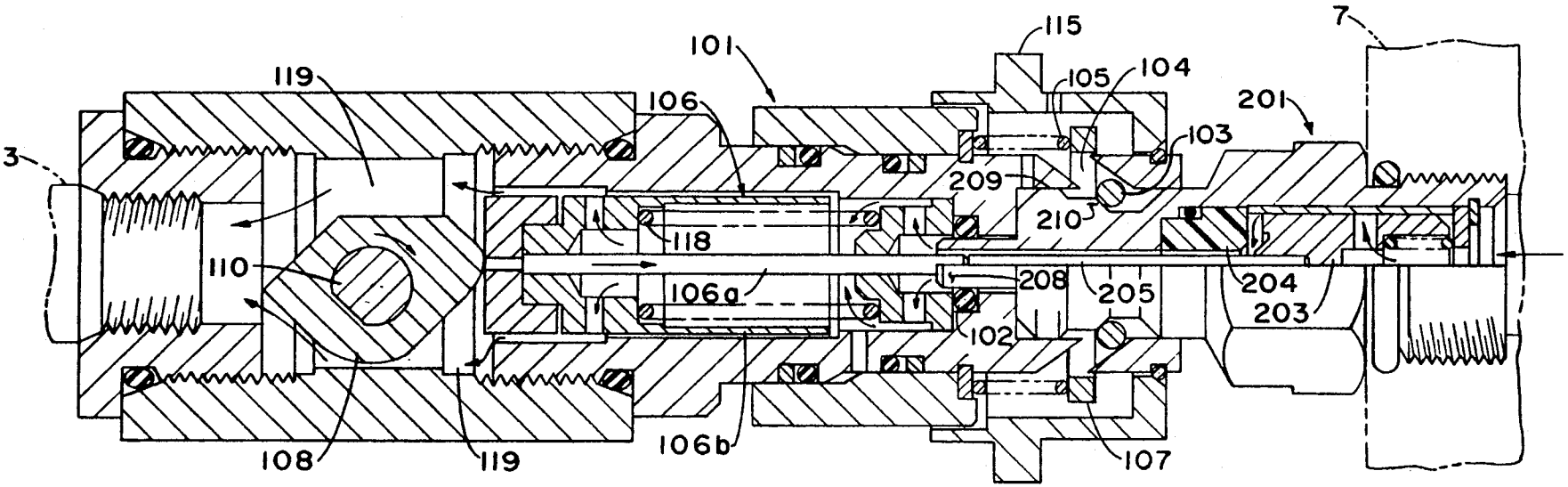
FIG. 3 is a cross sectional view of the quick connect check valve and socket assembly of FIG. 2 in a fully connected position.
Figure 4:
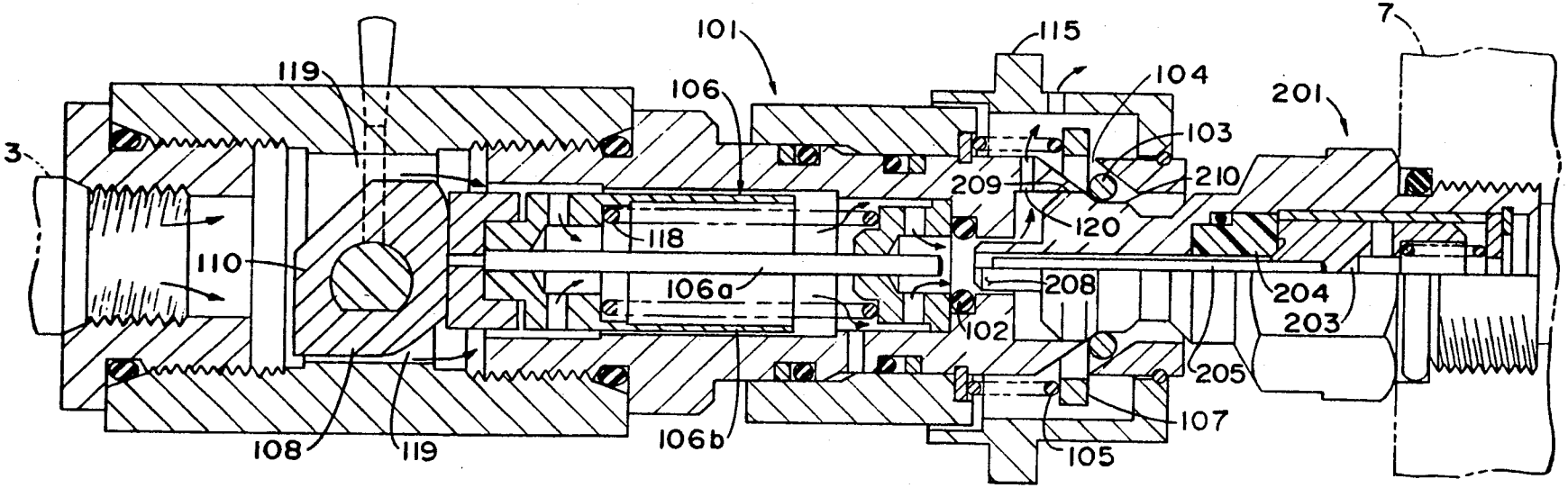
FIG. 4 is a cross sectional view of the quick connect check valve and socket assembly of FIG. 2 in a vent position.

With reference to FIG. 2 through FIG. 4, the connection between the hose 3 and one SCBA is accomplished by connecting socket assembly 101 to check valve 201 that is seated in the outlet of coupling 7. In the fully disconnected position, as shown in FIG. 2, high pressure air is prevented from flowing out of the donor system by check valve 201 as high pressure in coupling 7 forces valve poppet 203 in contact with seat 204. Valve poppet 203 is rigidly attached to a steel rod 205 that is situated inside of an air tunnel 206. The rod 205 is situated so that it can slide back and forth inside of air tunnel 206.

In FIG. 3, the check valve 201 is shown connected to the socket 101. When the check valve 201 is slid into the socket 101, the nose 208 of the check valve 201 is sealed to the socket by O-ring 102.

The check valve 201 is locked in place by two locking pins 103. When the check valve 201 is pushed into the socket 101, the locking pins 103 are pushed up inclined paths 104 by the forward lip 209 of the check valve 201. The locking pins 103 are held in contact to a sliding sleeve 115 by a spring 105 and thrust washer 107. As the large lip 209 passes beyond the locking pins 103, sleeve 115 slides forward and the locking pins 103 slide back down the inclined paths 104, past small lip 210, locking the valve 201 into the socket 101.

Positioned inside of socket 101 is a valve actuator assembly 106, comprising a rod 106*a* and a hollow piston 106*b*, that can slide back and forth inside of the socket body 117. Spring 118 urges the assembly against cam 108. The air passage through the socket always remains open, via ports 119, the passage through piston 106*b* and vent port 120. Actuator cam 108 is attached to actuator cam shaft 110 that is turned by a lever 111 outside the socket body 117.

The closed end of the socket 101 is attached to one end of an air line 3. The other end of the line 3 is attached to a second socket (not shown) identical to that shown in FIGS. 2, 3 and 4. The connection between the two high pressure sources is made by first attaching one socket 101 to the check valve 201 of the donor tank. Then, the second socket 101 is pushed onto the check valve 201 of the donee tank. The actual order of connection is unimportant since the first connection can be made either to the donor tank or to the donee tank.

After the connections have been made, the lever 111 of the socket connected to the donor apparatus is depressed causing the cam 108 to rotate and move the actuator assembly 106 toward the check valve 201. The actuator rod 106*a* forces the check valve rod 205 and valve poppet 203 inward, holding check valve 201 of the donor apparatus in an open position. Air will now flow to the donee apparatus through the air line 3, the socket 101 and check valve 201 connection made with the donee apparatus, the air pressure from the donor apparatus forcing open the check valve on the donee apparatus. Flow can be increased by depressing the lever on the socket connected to the donee apparatus, thereby mechanically completely opening the check valve on the donee apparatus.

When the pressure between the two air sources has equalized, the sockets 101 are separated from the check valves 201. The illustrated embodiment provides for venting pressure from the transfer line before the connection can be separated. With reference to FIG. 4, the sleeve 115 is pulled back away from the check valves 201, thereby causing the locking pins 103 to slide back up the inclined paths 104 to a vent position. Locking pins 103 are held in contact to the sleeve 115 by spring 105 and thrust washer 107. As the sleeve 115 is pulled away from the check valve 201, the locking pins 103 pivot away from center as they are drawn up incline paths 104 and beyond check valve lip 210. The partial separation of the check valve and socket 101, limited by the locking pins 103 engaging flange 209, permits venting into the atmosphere through the air vents 120. The check valve 201 then closes instantaneously as the vent 120 is opened.

Figure 5:
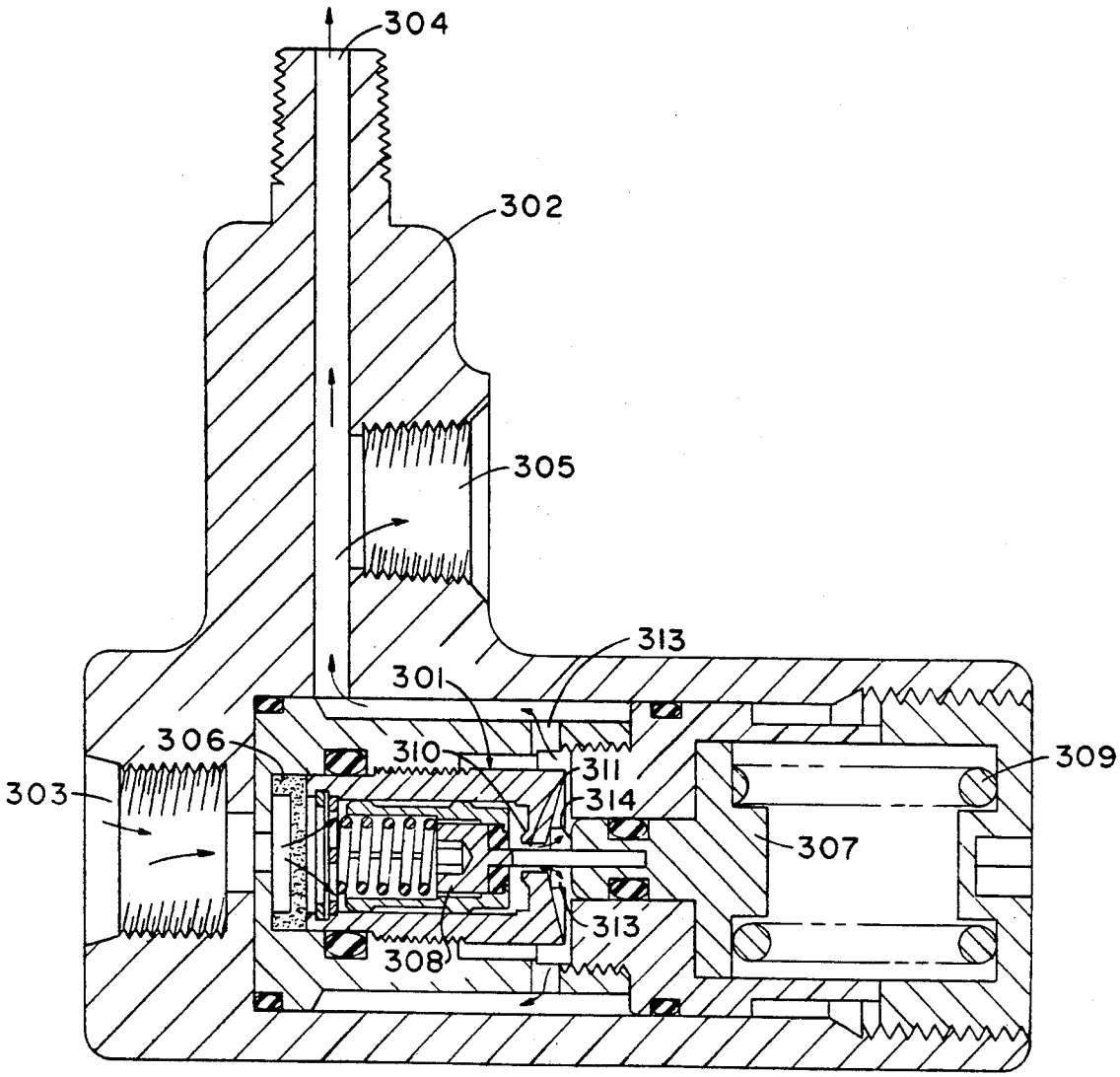
FIG. 5 is a cross sectional view of an alternative coupling incorporating a pressure limiting valve.

FIG. 5 is a modified coupling, incorporating a pressure limiting valve, that can be used to limit the amount of air transferred to the donee apparatus. When transferring high pressure air, the limiting valve 301 limits the amount of air pressure delivered to the donee tank to a predetermined maximum pressure. Thus the pressure limiting valve 301 can be used to prevent the overfilling of a donee tank, having a maximum pressure capacity of 2200 psi, by a donor tank having a pressure greater that 2200 psig, such as 4500 psig apparatus that is also now in use.

The limiting valve 301 is positioned inside of a housing 302. The housing 302 has three outlets, 303, 304 and 305. Outlet 303 is adapted to receive a check valve 201, outlet 304 is adapted to receive a regulator, and outlet 305 is adapted to be connected to a high pressure source.

When the donee apparatus is connected to receive air from the donor apparatus through a check valve opening to outlet 303, air enters through filter 306 and into the valve assembly 301. At source pressures below 2200 psi, the valve piston 307 keeps the valve poppet 308 unseated from valve seat 310, allowing air to flow around the valve poppet 308, through seat opening 311, and ports 313, to the donee source. If the pressure at the face 314 of piston 307 exceeds 2200 psi, the piston 307 moves to the right, overcoming the spring force caused by spring 309, seating valve poppet 308 and thereby closing the valve.

Although the invention has been described with reference to a specific embodiment, it will be clear to those skilled in the art that many variations and modifications may be made from the details set forth in the specification, without departing from the inventive concepts disclosed herein.

I claim:

1. A high pressure gas transfer system comprising a first and second breathing apparatus, each apparatus comprising, a high pressure breathing gas tank having an outlet, coupling means having a first opening fluidically connected to said outlet, said coupling means having second and third openings, the second opening being an outlet from the apparatus, pressure reducing means fluidically connected to said third opening, and means fluidically connected to said pressure reducing means for delivering breathing gas to a user;

the pressure of breathing gas in the tank of said first apparatus being at a higher pressure than the pressure of breathing gas in the tank of said second apparatus, a detachable high pressure conduit fluidically interconnecting the said second opening of the first apparatus with the said second opening of the second apparatus, first valve means for selectively opening and closing the said second opening of the first apparatus, said first valve means for permitting flow from the tank of the first apparatus into the high pressure conduit when said first valve means is open, second valve means for selectively opening and closing the said second opening of the second apparatus, said second valve means for permitting flow into the tank of the second apparatus from the high pressure conduit when said second valve means is open, whereby breathing gas is transferred from the tank of the first apparatus to the tank of the second apparatus when the first and second valve means are opened.

2. A system according to claim 1 in which the second apparatus has third valve means that closes the second opening of the second apparatus when the second apparatus tank pressure exceeds a predetermined pressure.

3. A system according to claim 1 in which the first valve means is a check valve means normally preventing flow from the first apparatus.

4. A system according to claim 3 in which said conduit includes mechanical actuating means operable on manual connection of the conduit to the first apparatus to engage and open the check valve means to permit flow from the apparatus.

5. A system according to claim 3 where said high pressure conduit comprises a hose having a quick connect fitting means on each end that is adapted to connect to said second openings.

6. A self contained breathing apparatus comprising means for supplying high pressure breathing gas to a first user;

a high pressure breathing gas tank for a second user having an outlet, the breathing gas pressure in the tank being lower than the breathing gas pressure from said supply means;

coupling means having a first opening fluidically connected to said outlet;

said coupling means having second and third openings, the second opening being an outlet from the apparatus;

said means for supplying high pressure breathing gas connected to said second opening;

a first valve means for selectively opening and closing said second opening, said first valve means for permitting flow into the tank from the supply means when the said first valve means is open;

a second valve means that closes in response to the pressure of breathing gas in the tank exceeding a predetermined pressure to prevent further flow from the supply means through the second opening into the tank, pressure reducing means fluidically connected to said third opening; and means fluidically connected to said pressure reducing means for delivering breathing gas to the second user, whereby breathing gas is transferred from the supplying means to the tank when the first and second valve means are open.

7. A self contained breathing apparatus according to claim 6 where said first valve means is a check valve means normally preventing flow from the apparatus.

8. A system for filling of breathing apparatuses comprising a source of compressed breathing gas having a high pressure outlet and means fluidically connecting the source to a first user;

a self contained breathing apparatus for a second user comprising a high pressure breathing gas tank having an outlet, the breathing gas pressure in the tank being lower than the breathing gas pressure in said source, coupling means having a first opening fluidically connected to said outlet, said coupling means having second and third openings, the second opening being an outlet from the apparatus;

pressure reducing means fluidically connected to said third opening; and means fluidically connected to said pressure reducing means for delivering breathing gas to a user;

a detachable high pressure conduit fluidically interconnecting said second opening and the said outlet from the source of compressed breathing gas, first valve means for selectively opening and closing said second opening, said first valve means for permitting flow into the tank from the high pressure conduit when the first valve means is open, and second valve means that closes in response to the pressure of breathing gas in the tank exceeding a predetermined pressure to prevent further flow from the high pressure conduit through the second opening into the tank, whereby breathing gas is transferred from the source to the tank when the first and second valve means are open.

9. A system according to claim 8 where said first valve means is a check valve means normally preventing flow from the apparatus.

* * * * *